US010010934B2

(12) United States Patent
Chen et al.

(10) Patent No.: US 10,010,934 B2
(45) Date of Patent: Jul. 3, 2018

(54) EXHAUSTING DEVICE OF LOW-PRESSURE ALUMINUM ALLOY WHEEL CASTING MOLD

(71) Applicant: CITIC Dicastal CO., LTD, Qinhuangdao (CN)

(72) Inventors: Lu Chen, Qinhuangdao (CN); Longtao Kang, Qinhuangdao (CN); Xiwei Xue, Qinhuangdao (CN); Hongbiao Li, Qinhuangdao (CN); Kaiqing Wang, Qinhuangdao (CN); Changhai Li, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 0 days.

(21) Appl. No.: 15/581,184

(22) Filed: Apr. 28, 2017

(65) Prior Publication Data

US 2017/0312819 A1 Nov. 2, 2017

(30) Foreign Application Priority Data

May 1, 2016 (CN) ..... 2016 1 0277226

(51) Int. Cl.
*B22C 9/28* (2006.01)
*B22D 18/04* (2006.01)
(Continued)

(52) U.S. Cl.
CPC ..... *B22D 45/00* (2013.01); *B22C 9/067* (2013.01); *B22C 9/28* (2013.01); *B22D 18/04* (2013.01); *B22D 21/007* (2013.01); *B22D 27/00* (2013.01)

(58) Field of Classification Search
CPC ..... B22C 9/28; B22D 18/04
See application file for complete search history.

(56) References Cited

U.S. PATENT DOCUMENTS 5,042,561 A * 8/1991 Chandley ..... B22D 18/04 164/119
5,896,912 A * 4/1999 Monroe ..... B22C 9/28 164/119

FOREIGN PATENT DOCUMENTS

CN 101934361 A * 1/2011
CN 102699310 A * 10/2012
CN 102717049 A * 10/2012

OTHER PUBLICATIONS

EPO machine translation of CN-101934361-A (Year: 2011).*
EPO machine translation of CN-102699310-A (Year: 2012).*
EPO machine translation of CN-102717049-A (Year: 2012).*

* cited by examiner

*Primary Examiner* — Kevin E Yoon
(74) *Attorney, Agent, or Firm* — Maier & Maier, PLLC

(57) ABSTRACT

An exhausting device of a low-pressure aluminum alloy wheel casting mold, which includes a control mainframe, a connecting line, a gas storage station, a ventilating pipeline, gas inlet plugs, an exhausting plug and the like, the control mainframe is connected with the gas storage station through the connecting line, and the gas storage station is connected with the gas inlet plugs through the ventilating pipeline; the gas inlet plugs are arranged at the bottom mold window; the mold filling process of the high-temperature molten aluminum can be completed in a relatively oxygen-free environment, direct contact between the molten aluminum and oxygen is avoided, and the occurrence probability of the oxidation slag inclusion defect in the wheel casting process is effectively controlled, so that the internal quality of the casting is remarkably improved.

4 Claims, 3 Drawing Sheets

(51) Int. Cl.

| | |
|---|---|
| ***B22D 45/00*** | (2006.01) |
| ***B22D 21/00*** | (2006.01) |
| ***B22D 27/00*** | (2006.01) |
| ***B22C 9/06*** | (2006.01) |

EXHAUSTING DEVICE OF LOW-PRESSURE ALUMINUM ALLOY WHEEL CASTING MOLD

TECHNICAL FIELD

The invention relates to a casting mold, in particular to a wheel casting mold.

BACKGROUND ART

At present, aluminum alloy wheels are manufactured by mainly adopting a low-pressure casting production process. Due to the fact that the whole mold system is always located in a relatively open atmospheric environment and due to the easy oxidation characteristic of aluminum alloy, oxidation slag inclusion becomes one of common defects of wheel castings. Such defect causes reduction of the density of product organization and weakens the integrity of castings, the mechanical properties and service life of wheels cannot always meet the using requirements of clients, meanwhile the defect is not easily found through X-ray inspection, and therefore, great harm is brought. In actual wheel production, air in a cavity is generally exhausted as much as possible by arranging an exhausting plug at an inner rim of a top mold and scribing mark lines so as to reduce the oxygen degree of molten aluminum, but it is actually proved that the effect is not obvious.

Based on the above analysis, the problem of air residue in the cavity is required to be fundamentally solved for better decreasing or even eliminating the oxidation slag inclusion defects produced in aluminum alloy wheel production, a good environmental atmosphere is created for molten aluminum alloy mold filling by adopting some effective means, and it also becomes a significant problem to be solved by engineering technicians.

SUMMARY OF THE INVENTION

The technical scheme of the present invention is that an exhausting device of a low-pressure aluminum alloy wheel casting mold comprises a control mainframe, a connecting line, a gas storage station, a ventilating pipeline, gas inlet plugs, an exhausting plug, gas inlet mark lines, exhausting mark lines and a small air duct. The control mainframe is connected with the gas storage station through the connecting line, and the gas storage station is connected with the gas inlet plugs through the ventilating pipeline. The gas inlet plugs are arranged at a bottom mold window position; the gas inlet plugs are connected with the inner side of the ventilating pipeline, while the outer side is connected to the gas storage station through the line. When a panel push button is controlled to make the mold begin to go down for mold closing, a device mainframe system sends out an instruction to the gas storage station and automatically turns on an inert gas container control valve, and gas enters a cavity through the bottom mold gas inlet plugs under the pressure effect; after a liquid lifting stage is completed, a time controller inside the mainframe automatically turns off the control valve, and accordingly gas delivery is completed; the exhausting plug is arranged at an inner rim to make the gas in the cavity exhausted smoothly during molten aluminum mold filling, accordingly the formation of internal back pressure is avoided, and mold filling of molten aluminum is unobstructed. By means of the above measures, a high-temperature molten aluminum mold filling stage can be ensured, the whole mold cavity is always located in an inert gas protection atmosphere, direct contact between molten aluminum and oxygen is avoided, and the occurrence probability of the oxidation slag inclusion is reduced.

The number of the gas inlet plugs is 1 to 3, one end of each gas inlet plug is provided with an outer thread, and the inner diameter of each gas inlet plug is 5 to 8 mm.

The gas inlet mark lines are arranged on each gas inlet plug, the number of the gas inlet mark lines is 3 to 6, the width of each gas inlet mark line is 0.2 to 0.3 mm, the height of each gas inlet mark line is 10 to 20 mm, and the gas inlet mark lines are the passages for inert gas to enter the cavity. The exhausting plug is stepped, the exhausting mark lines are arranged on the exhausting plug, the number of the exhausting mark lines is 3 to 6, the width of each exhausting mark line is 0.2 to 0.3 mm, the height of each exhausting mark line is 10 to 30 mm, the exhausting mark lines are the passages for exhausting air and inert gas out of the cavity, the formation of back pressure in the cavity is avoided, and then smooth mold filling of the molten aluminum is unobstructed. The ventilating pipeline is configured to be in a single-pipe double-inlet mode so that gas can be evenly led to make the cavity full of the gas. The ventilating pipeline 4 is in welded or threaded connection with the gas inlet plugs 5. The inert gas can be argon gas or nitrogen gas, and the gas pressure is set as 0.2-0.6 Mpa.

The present invention has the advantages that the inert gas is reasonably inducted into the cavity of the casting mold by virtue of ambient pressure, the mold filling process of the high-temperature molten aluminum can be completed in a relatively oxygen-free environment by exhausting the air in the cavity in advance, direct contact between molten aluminum and oxygen is avoided, and the occurrence probability of the oxidation slag inclusion defect in the wheel casting process is effectively controlled, so that the internal quality of the casting is remarkably improved, the mechanical properties are obviously improved as well, and the service life is also obviously prolonged. In addition, the structure is simple in structure and easy to be obtained.

In Figures: 1—control mainframe, 2—connecting line, 3—gas storage station, 4—ventilating pipeline, 5—gas inlet plug, 6—exhausting plug, 7—gas inlet mark line, 8—exhausting mark line, 9—small air duct.

DETAILED DESCRIPTION OF THE INVENTION

Figure 1:
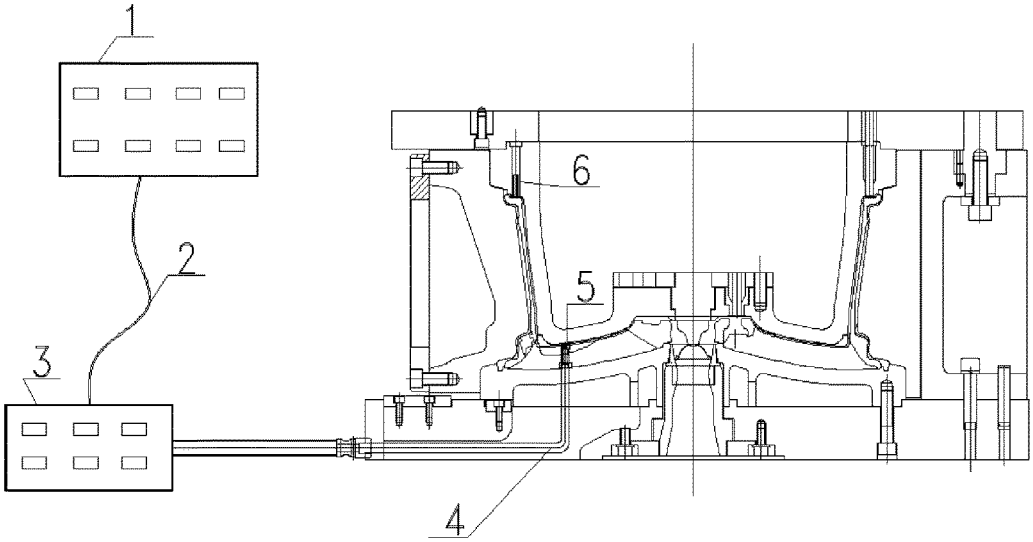
FIG. 1 is a schematic arrangement diagram of an improved low-pressure wheel casting mold system of the present invention.
Figure 2:
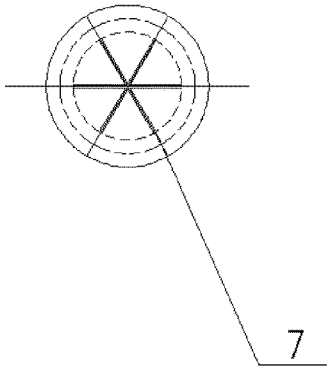
FIG. 2 is a schematic diagram of an exhausting device of a low-pressure aluminum alloy wheel casting mold of the present invention.
Figure 3:
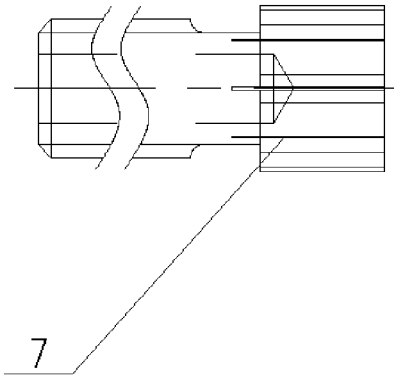
FIG. 3 is a structural schematic diagram of gas inlet plugs of the exhausting device of the low-pressure aluminum alloy wheel casting mold of the present invention.
Figure 4:
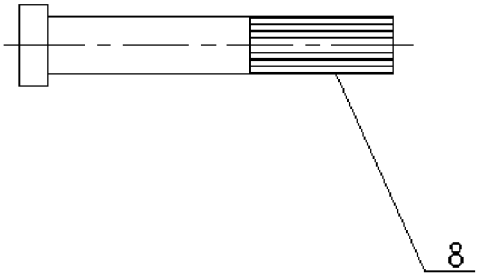
FIG. 4 is a structural schematic diagram of an exhausting plug of the exhausting device of the low-pressure aluminum alloy wheel casting mold of the present invention.
Figure 5:
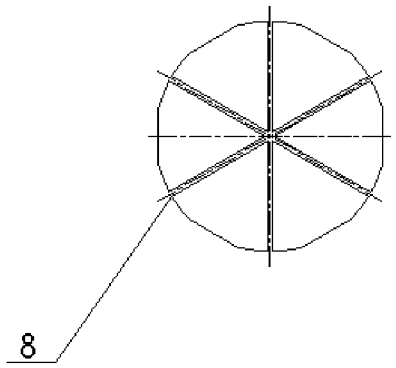
FIG. 5 is a structural schematic diagram of the exhausting plug of the exhausting device of the low-pressure aluminum alloy wheel casting mold of the present invention.
Figure 6:
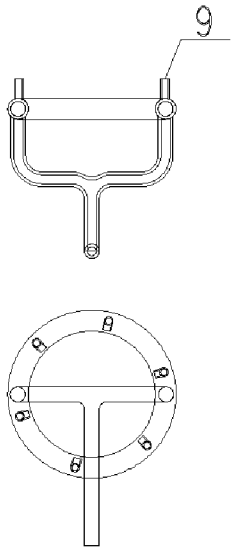
FIG. 6 is a structural schematic diagram of a ventilating pipeline of the exhausting device of the low-pressure aluminum alloy wheel casting mold of the present invention.

As shown in FIG. 1, during mold closing, the control mainframe 1 sends out a signal and transmits an instruction to the gas storage station 3 through the line 2 to make the gas storage station 3 automatically turn on the inert gas container control valve, inert gas flows to a bottom mold back cavity through the ventilating pipeline 4 and enters a mold cavity through the gas inlet plugs 5 arranged at a window. After a liquid lifting stage is completed, a time controller inside the mainframe also rapidly transmits the signal to the gas storage station 3, so that the control valve is turned off to complete the process of gas delivery towards the cavity. At a mold filling stage, high-temperature molten aluminum is always located in a good oxygen-free environment, and mold filling crystallization is achieved under the protection of the inert gas. Meanwhile, the exhausting plug 6 is arranged at an inner rim so that on one hand, the original air in the cavity can be dispelled during gas feeding; on the other hand, the inert gas can also be smoothly exhausted under the forcing of the molten aluminum, the formation of back pressure in the cavity is avoided, and then mold filling stability is not affected. The above process is cyclically repeated to achieve continuous production of wheel castings.

Embodiment 1 the number of the gas inlet plugs 5 is 1, one end of the gas inlet plug 5 is provided with an outer thread, and the inner diameter of the gas inlet plug 5 is 8 mm. The gas inlet mark lines 7 are arranged on the gas inlet plug 5, the number of the gas inlet mark lines 7 is 3, the width of each of the gas inlet mark lines 7 is 0.3 mm, the height of each of the gas inlet mark lines 7 is 10 mm, and the gas inlet mark lines 7 are the passages for the inert gas to enter the cavity. The exhausting plug 6 is stepped, the exhausting mark lines 8 are arranged on the exhausting plug 6, the number of the exhausting mark lines 8 is 3, the width of each of the exhausting mark lines 8 is 0.3 mm, the height of each of the exhausting mark lines 8 is 10 mm, the exhausting mark lines 8 are the passages for exhausting air and inert gas out of the cavity, the formation of back pressure in the cavity is avoided, and then smooth mold filling of the molten aluminum is unobstructed.

The ventilating pipeline 4 is configured to be in a single-pipe double-inlet mode so that gas can be evenly led to make the cavity be full of the gas. The ventilating pipeline 4 is in threaded connection with the gas inlet plugs 5. The inert gas is argon gas, and gas pressure is set as 0.6 Mpa.

Embodiment 2 the number of the gas inlet plugs 5 is 2, one end of each of the gas inlet plugs 5 is provided with an outer thread, and the inner diameter of each of the gas inlet plugs 5 is 7 mm. The gas inlet mark lines 7 are arranged on the gas inlet plugs 5, the number of the gas inlet mark lines 7 is 5, the width of each of the gas inlet mark lines 7 is 0.25 mm, the height of each of the gas inlet mark lines 7 is 15 mm, and the gas inlet mark lines 7 are the passages for inert gas to enter the cavity. The exhausting plug 6 is stepped, the exhausting mark lines 8 are arranged on the exhausting plug 6, the number of the exhausting mark lines 8 is 5, the width of each of the exhausting mark lines 8 is 0.25 mm, the height of each of the exhausting mark lines 8 is 20 mm, the exhausting mark lines 8 are the passages for exhausting air and inert gas out of the cavity, the formation of back pressure in the cavity is avoided, and then smooth mold filling of the molten aluminum is unobstructed.

The ventilating pipeline 4 is configured to be in the single-pipe double-inlet mode so that gas can be evenly led to make the cavity be full of the gas; the ventilating pipeline 4 is in welded connection with the gas inlet plugs 5. The inert gas is nitrogen gas, and gas pressure is set as 0.5 Mpa.

Embodiment 3 the number of the gas inlet plugs 5 is 3, one end of each of the gas inlet plugs 5 is provided with an outer thread, and the inner diameter of each of the gas inlet plugs 5 is 5 mm. The gas inlet mark lines 7 are arranged on the gas inlet plugs 5, the number of the gas inlet mark lines 7 is 6, the width of each of the gas inlet mark lines 7 is 0.2 mm, the height of each of the gas inlet mark lines 7 is 20 mm, and the gas inlet mark lines 7 are the passages for inert gas to enter the cavity. The exhausting plug 6 is stepped, the exhausting mark lines 8 are arranged on the exhausting plug 6, the number of the exhausting mark lines 8 is 6, the width of each of the exhausting mark lines 8 is 0.2 mm, the height of each of the exhausting mark lines 8 is 30 mm, the exhausting mark lines 8 are the passages for exhausting air and inert gas out of the cavity, the formation of back pressure in the cavity is avoided, and then smooth mold filling of the molten aluminum is unobstructed.

The ventilating pipeline 4 is configured to be in the single-pipe double-inlet mode so that gas can be evenly led to make the cavity be full of the gas; the ventilating pipeline 4 is in threaded connection with the gas inlet plugs 5. The inert gas is nitrogen gas, and gas pressure is set as 0.2 Mpa.

The invention claimed is:

1. An exhausting device of a low-pressure aluminum alloy wheel casting mold, comprising: a control mainframe, a connecting line, a gas storage station, a ventilating pipeline, gas inlet plugs, an exhausting plug, gas inlet mark lines, exhausting mark lines, and a small air duct, wherein the control mainframe is connected with the gas storage station through the connecting line; the gas storage station is connected with the gas inlet plugs through the ventilating pipeline and stores inert gas which is input into a mold cavity of the casting mold before filling the mold cavity with molten aluminum, in order to protect the molten aluminum inside the mold cavity from contacting oxygen; the gas inlet plugs are arranged at a window of a bottom mold of the casting mold for allowing the inert gas entering the mold cavity through channels formed by the gas inlet mark lines, and the exhausting plug is positioned at an inner rim of a top mold of the casting mold for exhausting air and the inert gas out of the mold cavity through channels formed by the exhausting mark lines;

the number of the gas inlet plugs is 1 to 3, one end of each of the gas inlet plugs is provided with an outer thread, and the inner diameter of each of the gas inlet plugs is 5 to 8 mm; the gas inlet mark lines are arranged on the gas inlet plugs, the number of the gas inlet mark lines is 3 to 6, the width of each of the gas inlet mark lines is 0.2 to 0.3 mm, and the height of each of the gas inlet mark lines is 10 to 20 mm; the exhausting plug is stepped, the exhausting mark lines are arranged on the exhausting plug, the number of the exhausting mark lines is 3 to 6, the width of each of the exhausting mark lines is 0.2 to 0.3 mm, and the height of each of the exhausting mark lines is 10 to 30 mm; the ventilating pipeline is configured to be in a single-pipe double-inlet mode, and the ventilating pipeline is in welded or threaded connection with the gas inlet plugs; the inert gas can be argon gas or nitrogen gas, and gas pressure is set as 0.2-0.6 Mpa.

2. The exhausting device of the low-pressure aluminum alloy wheel casting mold according to claim 1, wherein the number of the gas inlet plugs is 1, the inner diameter of the gas inlet plug is 8 mm, the gas inlet mark lines are arranged on the gas inlet plug, the number of the gas inlet mark lines is 3, the width of each of the gas inlet mark lines is 0.3 mm, and the height of each of the gas inlet mark lines is 10 mm; the exhausting mark lines are arranged on the exhausting plug, the number of the exhausting mark lines is 3, the width of each of the exhausting mark lines is 0.3 mm, and the height of each of the exhausting mark lines is 10 mm; the ventilating pipeline is in threaded connection with the gas inlet plugs, the inert gas is argon gas, and the gas pressure is set as 0.6 Mpa.

3. The exhausting device of the low-pressure aluminum alloy wheel casting mold according to claim 1, wherein the number of the gas inlet plugs is 2, and the inner diameter of each of the gas inlet plugs is 7 mm; the gas inlet mark lines are arranged on the gas inlet plugs, the number of the gas inlet mark lines is 5, the width of each of the gas inlet mark lines is 0.25 mm, and the height of each of the gas inlet mark lines is 15 mm; the exhausting mark lines are arranged on the exhausting plug, the number of the exhausting mark lines is 5, the width of each of the exhausting mark lines is 0.25 mm, the height of each of the exhausting mark lines is 20 mm, the ventilating pipeline is in welded connection with the gas inlet plugs, the inert gas is nitrogen gas, and the gas pressure is set as 0.5 Mpa.

4. The exhausting device of the low-pressure aluminum alloy wheel casting mold according to claim 1, wherein the number of the gas inlet plugs is 3, and the inner diameter of each of the gas inlet plugs is 5 mm; the gas inlet mark lines are arranged on the gas inlet plugs, the number of the gas inlet mark lines is 6, the width of each of the gas inlet mark lines is 0.2 mm, and the height of each of the gas inlet mark lines is 20 mm; the exhausting mark lines are arranged on the exhausting plug, the number of the exhausting mark lines is at least 6, the width of each of the exhausting mark lines is 0.2 mm, the height of each of the exhausting mark lines is 30 mm, the ventilating pipeline is in threaded connection with the gas inlet plugs; the inert gas is nitrogen gas, and the gas pressure is set as 0.2 Mpa.

* * * * *